US006931137B2

(12) United States Patent
Arndt et al.

(10) Patent No.: US 6,931,137 B2
(45) Date of Patent: Aug. 16, 2005

(54) FEEDBACK COMPENSATION DEVICE AND METHOD, AND HEARING AID DEVICE EMPLOYING SAME

(75) Inventors: Georg-Erwin Arndt, Obermichelbach (DE); Tom Weidner, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 0 days.

(21) Appl. No.: 10/675,305

(22) Filed: Sep. 30, 2003

(65) Prior Publication Data

US 2004/0101147 A1 May 27, 2004

(30) Foreign Application Priority Data

Sep. 30, 2002 (DE) ..... 102 45 667

(51) Int. Cl.[7] ..... H04R 25/00
(52) U.S. Cl. ..... 381/83; 381/93; 381/318
(58) Field of Search ..... 381/59, 83, 93, 381/95, 96, 316, 318

(56) References Cited

U.S. PATENT DOCUMENTS

| | | | | |
|---|---|---|---|---|
| 6,539,091 | B1 | 3/2003 | Schertler | |
| 6,606,391 | B2 * | 8/2003 | Brennan et al. | 381/316 |
| 6,618,481 | B1 | 9/2003 | Schmidt | |

FOREIGN PATENT DOCUMENTS

| | | |
|---|---|---|
| DE | 197 14 966 | 4/1999 |
| DE | 198 05 942 | 8/1999 |

* cited by examiner

*Primary Examiner*—Suhan Ni
(74) *Attorney, Agent, or Firm*—Schiff Hardin LLP

(57) ABSTRACT

A feedback compensator for a hearing aid device has a filter arrangement that splits a signal path, to implement an adaptive feedback compensation with only one buffer memory, two splitting nodes, and two addition nodes. The feedback compensation ensues only in the feedback-susceptible frequency range of the input signal. In addition to the filtering of the input signal, it is advantageous to feed to the adaptive feedback compensation filter a bandwidth-limited signal that is taken from the amplified output signal.

7 Claims, 2 Drawing Sheets

FEEDBACK COMPENSATION DEVICE AND METHOD, AND HEARING AID DEVICE EMPLOYING SAME

BACKGROUND OF THE INVENTION

1. Field of the Invention

The present invention concerns a feedback compensator in an acoustic amplification system to compensate a feedback signal that ensues upon amplification of an input signal due to a feedback path from an amplified output signal to the input signal. The invention also is directed to a hearing aid device with such a feedback compensator, a method for compensating a feedback signal in an acoustic amplification system, and a method for compensating feedback in a hearing aid device.

2. Description of the Prior Art

In hearing aid devices, the problem commonly exists of an undesired acoustic feedback between a speaker (earphone) and a microphone. Such a feedback can cause whistling noises or other disturbances and thereby significantly diminish, or even reduce to zero, the usefulness of the hearing aid device for the user. Depending on the characteristics of the hearing aid device and the auditory situation, a feedback can ensue at different frequencies.

By means of adaptive feedback compensators, it is known to generate a compensation signal that is subtracted from the input signal before the amplification, and thus a frequency causing the feedback is reduced to an intensity that is below the stability limit. The generation of the compensation signal ensues along a feedback compensation path with an adaptive feedback compensation filter that is adjusted by means of an adaptation unit and reproduces the feedback path. A frequency-limiting filter in the feedback compensation path limits the frequency range in which the compensation signal is generated.

The expenditure for realizing such feedback compensators is significant, due to the generation of the feedback compensation path equivalent to the feedback. The generation of the feedback compensation signal ensues for the most part with a special adaptive feedback compensation filter, known as an FIR (Finite Impulse Response) filter. The frequency-limited amplified output signal, that is converted by the FIR filter into the compensation signal, serves as the input signal to the FIR filter.

The effect (characteristics) of the FIR filter, representative of most feedback compensation filters, is adapted with an adaptation unit that adjusts the filter coefficients. The adaptation is based on a comparison of an error signal, usually the input signal, with the amplified output signal. An important requirement for a successful adaptation is that both signals have experienced a substantially identical filtering before the comparison.

For the assembly of a feedback compensator, nodes and computer operations in the signal path are necessary that occupy space and require computer capacity. Furthermore, buffer storage (memory) is required in order to process the signal, for example by means of the adaptation unit and the feedback compensation filter. Such storage requires space on the hearing aid device chip and additionally must be supplied with power by the hearing aid device battery.

Various feedback compensators are known, such as from PCT Application WO 00/19605. The bandwidth of the compensation signal is thereby limited so that disruptions generated by the feedback compensation filter on the amplified output signal are minimized and limited to the unstable frequency range. The feedback compensator specified in PCT Application WO 00/19605 is designed to operate the memory efficiently, however, it has complicated signal paths or feedback paths with a number of elaborate computer addition operations and nodes.

For example, in an embodiment disclosed in PCT Application WO 00/19605 an input signal is split into three signals. The first two are directly merged back after each is filtered, and form the input signal for the hearing aid device signal processor. A compensation signal of an adjustable FIR filter is subtracted from this input signal before the processing for feedback compensation. The third signal, after filtering thereof serves as an error signal for an adaptation unit of the feedback compensation filter. In order to be able to successfully implement the adaptation, the compensation signal generated by the FIR filter is subtracted not only from the input signal for the hearing aid device signal processor, but also is additionally subtracted from the error signal before the error signal is supplied to the adaptation unit. This embodiment has three addition nodes, three splitting nodes, and three filters for the compensation of the input signal, and thus is complicated to build.

Another technique is based on the use of two hearing aid device signal processors. For this, an input signal is split into two signals. The first signal is supplied after filtering to a first hearing aid device signal processor. The second signal is filtered complementary to the first signal before it is merged with a compensation signal. It is then supplied as an error signal to an adaptation unit of an adjustable FIR filter, as well as to a second hearing aid device signal processor. The output signal of the second hearing aid device signal processor is filtered at the FIR filter and supplied to the adaptation unit, as well as being merged with an output signal of the first hearing aid device signal processor. In this technique, the selection of the complementary filter affects the hearing aid device signal processors.

SUMMARY OF THE INVENTION

An object of the present invention is to provide a feedback compensator, a method to compensate a feedback signal in an acoustic amplification system, and a hearing aid device with feedback compensation, that require little storage and have a simple assembly and operating procedure with few nodes and few computer addition operations.

This object is achieved by a feedback compensator in an acoustic amplification system, to compensate a feedback signal that ensues given an amplification of an input signal due to a feedback path from an amplified output signal to the input signal, that has an adaptive feedback compensation filter to form a feedback compensation path copying (mimicking) the feedback path, an adaptation unit to adapt the feedback compensation filter, and a frequency limiting filter to limit the frequency range of the feedback compensation path. An input signal path of the input signal is split two signal paths. The first signal path has a first filter and the second signal path has a second filter, The first signal path is functionally connected after the first filter to a first node to subtract a compensation signal to the feedback compensation filter, and to a second node to deliver error signals to the adaptation unit. An output of the second node and the second signal path is connected with a third node for addition, and an output of the third node is connected with an input of the amplification system.

The feedback compensator according to the invention enables the adaptation unit and the feedback compensation filter to be supplied with an output signal that is filtered with the same filter, such that only a buffer storage is necessary for the feedback compensation. This is based on the inventive arrangement of the filters, nodes, and computer addition operations in the signal path. Furthermore, the feedback compensator according to the invention requires only two addition nodes and splitting nodes each, as well as a complementary filter pair. The arrangment thus can be built economically and simply. Only one filter to limit the frequency range is used in the feedback compensation path. This has the advantage that artifacts in the low frequency range are lessened. The control of the amplification system ensues independently of the parameters of the first and second filters, as well as independently of the frequency-limiting filter, since the feedback compensation applies to the entire amplification system. This enables a flexible selection of the filter, The object with regard to a hearing aid device is achieved by a hearing aid device that has a feedback compensator of the type described above. The invention can thereby be used in all known hearing aid device types, for example hearing aid devices wearable behind the ear, hearing aid devices wearable in the ear, implantable hearing aid devices, hearing aid device systems, or pocket hearing aid devices.

The above object also is achieved by a method for compensating a feedback signal in an acoustic system, the feedback signal ensuing given an amplification of an input signal due to a feedback path from an amplified output signal to the input signal, wherein the feedback path is copied by an adaptive feedback compensation filter controlled with an adaptation unit, wherein a frequency limiting filter limits the frequency range of the feedback path to be copied, and wherein the method includes the steps of splitting the input signal into a feedback-susceptible signal portion and a feedback-free signal portion, merging the feedback-unsusceptible signal portion with a compensation signal of the feedback compensation filter to from a feedback-compensated signal portion, supplying the feedback-compensated signal portion to the adaptation unit for error signal evaluation, and merging the feedback-compensated signal portion with the feedback-free signal portion to form a feedback-compensated signal that is subsequently amplified.

The steps of the method need not necessarily proceed in the order described above, The first two methods in the sequence specified above alternatively can take place before the last two method steps. An advantage of the method lies is its simplified execution, as well as in a cost-effective realization of the method due to the reduced storage requirements and the efficient implementability.

In an embodiment of the feedback compensator according to the invention, it is used in a multi-channel amplification system that, for example, has a filter bank that distributes the input signal to a number of frequency-specific adapted amplification systems. This has the advantage that the feedback compensator simultaneously covers all frequency-specific adapted amplification systems.

In another embodiment of the feedback compensator, the frequency-limiting filter is arranged between the output of the amplification system and the feedback compensator as well as the adaptation unit. This has the advantage that the frequency-limiting filter affects only the feedback compensation path.

In a further embodiment of the feedback compensator, the first filter and the frequency-limiting filter exhibit substantially identical filter functions. Both inputs into the adaptation unit then are subjected to substantially identical filterings, namely the input signal by the first filter, and the amplified output signal by the frequency-limiting filter. This leads to particularly good conditions for a fast and accurate adaptation by the adaptation unit.

In another embodiment of the method the amplified output signal is fed via the frequency-limiting filter to the adaptation unit and to the feedback compensation the adaptation unit for error signal evaluation, and merging the feedback-compensated signal portion with the feedback-free signal portion to form a feedback-compensated signal that is subsequently amplified.

The steps of the method need not necessarily proceed in the order described above. The first two methods in the sequence specified above alternatively can take place before the last two method steps. An advantage of the method lies is its simplified execution, as well as in a cost-effective realization of the method due to the reduced storage requirements and the efficient implementability.

In an embodiment of the feedback compensator according to the invention, it is used in a multi-channel amplification system that, for example, has a filter bank that distributes the input signal to a number of frequency-specific adapted amplification systems. This has the advantage that the feedback compensator simultaneously covers all frequency-specific adapted amplification systems.

In another embodiment of the feedback compensator, the frequency-limiting filter is arranged between the output of the amplification system and the feedback compensator as well as the adaptation unit. This has the advantage that the frequency-limiting filter affects only the feedback compensation path.

In a further embodiment of the feedback compensator, the first filter and the frequency-limiting filter exhibit substantially identical filter functions. Both inputs into the adaptation unit then are subjected to substantially identical filterings, namely the input signal by the first filter, and the amplified output signal by the frequency-limiting filter. This leads to particularly good conditions for a fast and accurate adaptation by the adaptation unit.

In another embodiment of the method the amplified output signal is fed via the frequency-limiting filter to the adaptation unit and to the feedback compensation filter. This reduces the influence of the method on frequency ranges in which feedback seldom ensues, and reduces there the generation of artifacts In another embodiment of the method, the frequency ranges of the feedback-susceptible signal portion and of the feedback compensation path are selected such that they are approximately the same. This improves the adaptation in the adaptation unit.

In a further embodiment of the method, the amplification is implemented with a multi-channel amplification system.

Furthermore, the above object also is achieved in a method for operating a hearing aid device according to the above-described method.

DESCRIPTION OF THE PREFERRED EMBODIMENTS

Figure 1:
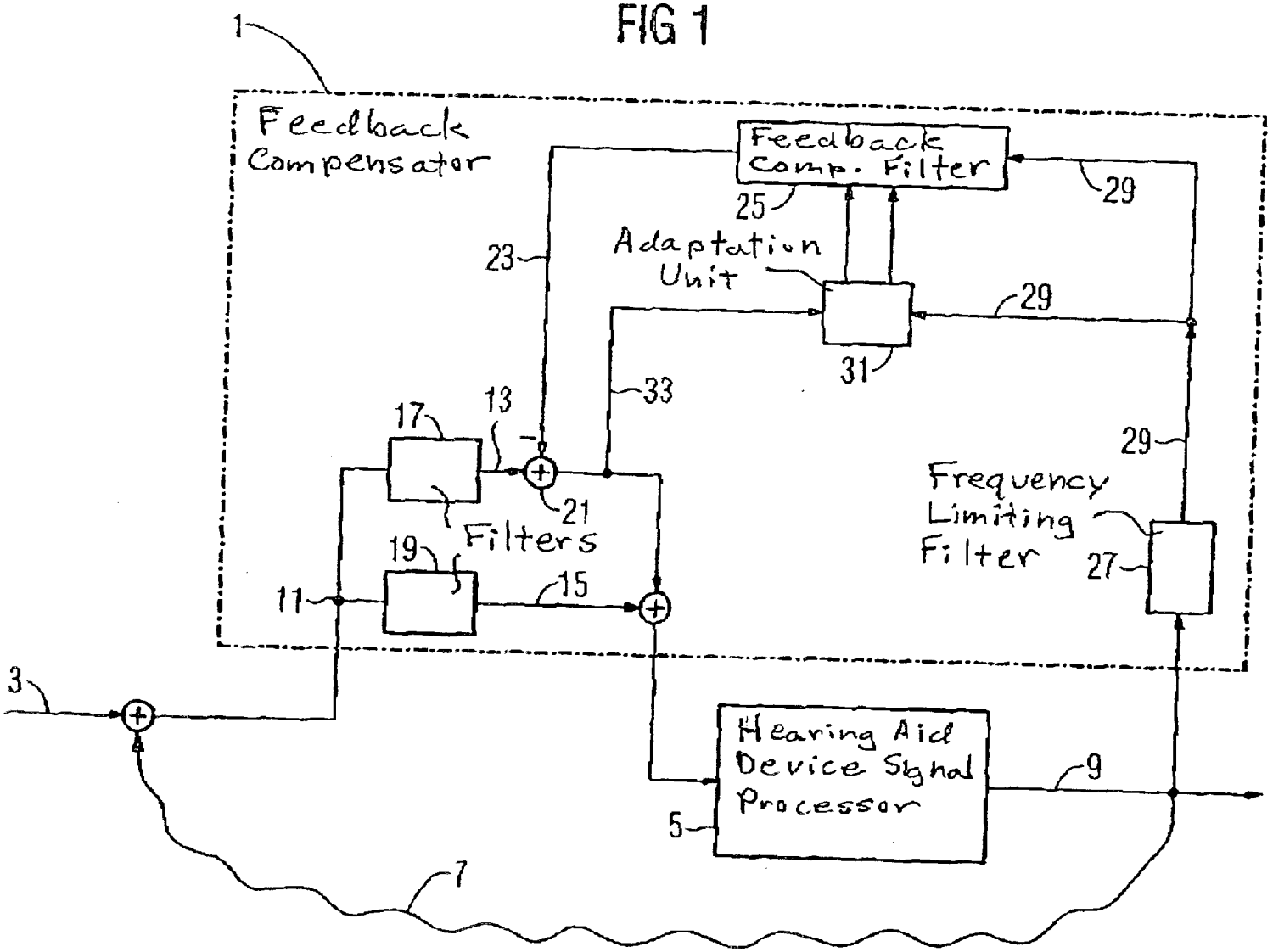
FIG. 1 is a schematic block diagram of a feedback compensator in accordance with the invention.

FIG. 1 schematically shows a feedback compensator 1 that enables a qualitatively good amplification of an acoustic input signal 3 with a hearing aid device signal processor 5 when a feedback path 7 is presents An output signal 9 together with the acoustic input signal 3 find a way back to the input to the hearing aid device signal processor 5 along a feedback path 7. In order to prevent whistling or other disturbances due to the feedback, the acoustic input signal 3 is modified with the aid of a feedback compensation path, such that the feedback ceases.

For this purpose, the acoustic input signal 3 is split at a splitting node II into two signal portions, namely a feedback-susceptible signal portion 13, and a feedback-free signal portion 15. Two complementary filters 17 and 19 implement the splitting in the frequency range, such that, for example, the first filter 17 allows only frequencies higher than one kilohertz to pass.

The feedback-susceptible signal portion 13 is merged with an inverted compensation signal 23 at an addition node 21 The compensation signal 23 is generated by a feedback compensation filter 25. An output signal 29 filtered with a frequency limiting filter 27 serves as the input into the feedback compensation filter 25. An adaptation unit 31 changes the coefficients of the feedback compensation filter 25 such that after passing through the feedback compensation filter 25, the filtered output signal 29 contains energy predominantly in the frequency range of the feedback.

A condition for successful adaptation is a significant error signal 33. Such an error signal is obtained from the feedback-susceptible signal portion 13 after the merger with the compensation signal 23 and is supplied to the adaptation unit 31 for evaluation.

After the extraction of the error signal 33, the feedback-susceptible signal portion 13 is merged at a further node with the feedback-free signal portion 15, before it arrives in the hearing aid device signal processing 5. There it is amplified corresponding to the hearing loss of the hearing aid device user and forwarded to a speaker (earphone). The signal course Implemented here is particularly advantageous in its execution, since functions with few nodes and computer operations.

The feedback path 7 can be acoustic feedback directly from the speaker to the input microphone, or electromagnetic feedback, for example from the speaker to a telephone coil within a hearing aid device.

The feedback compensator 1 requires only one memory for the filtered output signal 29, since, for processing, this is fed both to the feedback compensation filter 25 and the adaptation unit 31.

In the feedback compensator 1, the first filter 17 and the frequency limiting filter 27 have substantially the same filter function, since then the signal path to the adaptation unit 31 that begins with the output signal 9, passes through the same filter: In one case, the output signal 9 passes through the frequency limiting filter 27 and is subsequently directly supplied to the adaptation unit 31. In a second case, the compensation signal 31 that, starting from the amplified output signal 9, had passed through first the frequency limiting filter 27 and then the feedback compensation filter 25, is supplied to the adaptation unit 31 together with the feedback-susceptible signal portion 13. In a third case, the output signal that arrived along the feedback path 7 at the input signal 3 passes through the selected first filter 17 most identical to the frequency limiting filter 27. In this manner, a system to compensate feedbacks is assembled that is based on only two addition nodes and requires only one buffer storage.

The entire transfer function of the amplification system with the feedback compensator 1 is as follows:

F1 and F2 are the respective transfer functions of the first and second filters 17 and 19, F3 is the transfer function of the frequency limiting filter 27. H and H' are the respective transfer functions of the feedback path 7 and the feedback compensation filter 25, and G is the transfer function of the hearing aid device signal processor 5. The product from H of F2 can, given advantageous design of F1 and F2, be disregarded.

Figure 2:
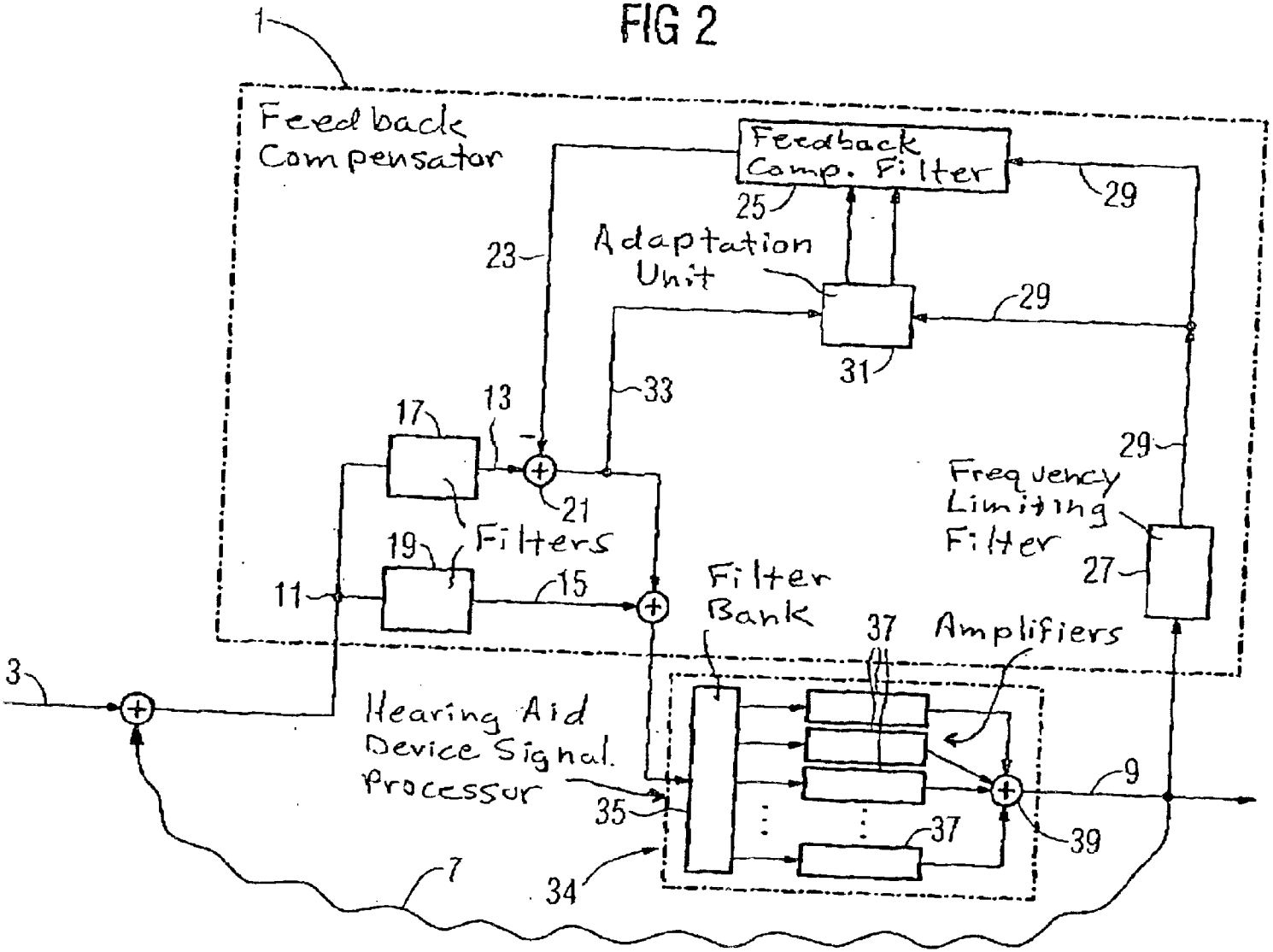
FIG. 2 is a schematic block diagram of a feedback compensator in accordance with the invention used with a multi-channel hearing aid device signal processor.

In FIG. 2, a schematic illustration of an alterative use of the feedback compensator 1 is shown. In contrast to FIG. 1, the signal processing is implemented by a multi-channel hearing aid device signal processor 34. For this, the signal again is merged after input into the multi-channel hearing aid device signal processor 34 by a filter bank 35 and is distributed to the different amplifiers 37 that operate in the various frequency ranges. The amplified signals are subsequently combined again in an addition node 39 into the amplified output signal 9. The advantage of this embodiment is that the adaptation of the multi-channel hearing aid device signal processor 34 to the hearing loss of the hearing aid device user is independent of the filter function of the frequency-limiting filter 27 or of the first filter 17. An influence of the parameters of the multi-channel hearing aid device signal processor 34 by the feedback compensator 1 is prevented by the inventive arrangement of the feedback compensator 1 and a separate adjustment of the parameters of the multichannel hearing aid device signal processor 34, as well as of the parameters of the feedback compensator 1, is achieved.

Although modifications and changes may be suggested by those skilled in the art, it is the intention of the inventors to embody within the patent warranted hereon all changes and modifications as reasonably and properly come within the scope of their contribution to the art.

We claim as our invention:

1. A feedback compensator for use with an acoustic amplifier to compensate feedback arising upon amplification of an input signal in an input signal path, in a feedback path between an amplified output signal and said input signal, said feedback compensator comprising:

an adaptive feedback compensation filter that forms a feedback compensation path mimicking said feedback path, and which generates a feedback compensation signal;

an adaptation unit connected to said adaptive feedback compensation filter for adapting said adaptive feedback compensation filter to form said feedback compensation path;

a frequency-limiting filter connected to limit a frequency range of said frequency compensation path;

a division of said input signal path into a first branch and a second branch;

a first filter in said first branch and a second filter in said second branch;

a first node in said first branch following said first filter, to which said feedback compensation signal is supplied, at which said feedback compensation signal is subtracted from an output of said first filter;

a second node in said first branch following said first node, from which an error signal is supplied to said adaptation unit; and a third node connected to said second node and to an output of said second filter to add said error signal and said output of said second filter to produce a signal adapted for supply to an input of the acoustic amplifier.

2. A feedback compensator as claimed in claim 1 wherein said acoustic amplifier has an output and said adaptive feedback compensation filter has an input, and wherein said frequency limiting filter is adapted to be connected to said output of said acoustic amplifier and is connected to said adaptive feedback compensation filter.

3. A feedback compensator as claimed in claim 1 wherein said first filter and said frequency limiting filter have substantially identical filter functions.

4. A method for compensating feedback in an acoustic system wherein an input signal, in an input signal path, is amplified to produce an amplified output signal and wherein a feedback path exists between the amplified output signal and the input signal, comprising the steps of:

in an electronic adaptive feedback compensation filter, electronically mimicking said feedback path to form a feedback compensation path;

adapting said adaptive feedback compensation filter to form said feedback compensation path;

limiting a frequency range of said feedback compensation path;

splitting said input signal into a feedback-susceptible signal portion and a feedback-free signal portion;

combining said feedback-susceptible signal portion with a feedback compensation signal generated by said adaptive feedback compensation filter to form said feedback-free signal portion;

using said feedback-free signal portion as an error signal to adapt said adaptive feedback compensation filter; and combining said feedback-susceptible signal portion with said feedback-free signal portion to form a feedback-compensated signal, and subsequently amplifying said feedback-compensated signal to produce said amplified output signal.

5. A method as claimed in claim 4 wherein the step of limiting a frequency range of said feedback compensation path comprises supplying said amplified output signal to said adaptive feedback compensation filter via a frequency-limiting filter.

6. A method as claimed in claim 4 comprising limiting said feedback-susceptible signal portion and feedback compensation path to a substantially identical frequency range.

7. A method as claimed in claim 4 comprising amplifying said input signal with respectively different amplification factors in different frequency ranges.

* * * * *